US007984818B1

(12) United States Patent
Fucito

(10) Patent No.: US 7,984,818 B1
(45) Date of Patent: Jul. 26, 2011

(54) VENTED NURSING BOTTLE WITH LEAK PREVENTION MEANS

(76) Inventor: Dominick Joseph Fucito, Sagamore Beach, MA (US)

( * ) Notice: Subject to any disclaimer, the term of this patent is extended or adjusted under 35 U.S.C. 154(b) by 505 days.

(21) Appl. No.: 12/215,781

(22) Filed: Jun. 30, 2008

(51) Int. Cl.
*A61J 9/04* (2006.01)

(52) U.S. Cl. ..... 215/11.5; 215/11.1; 215/902

(58) Field of Classification Search ..... 215/11.5, 215/11.1, 11.4, 902
See application file for complete search history.

(56) References Cited

U.S. PATENT DOCUMENTS

| | | | | |
|---|---|---|---|---|
| 2,239,275 | A * | 4/1941 | Schwab | 604/405 |
| 2,742,168 | A * | 4/1956 | Panetti | 215/11.4 |
| 3,059,797 | A * | 10/1962 | Wilkinson et al. | 215/11.1 |
| 3,120,330 | A * | 2/1964 | Ermecke | 222/386.5 |
| 4,940,152 | A * | 7/1990 | Lin | 215/11.5 |
| 5,779,071 | A * | 7/1998 | Brown et al. | 215/11.5 |
| 6,202,943 | B1 * | 3/2001 | Evans et al. | 239/333 |
| 7,798,347 | B2 * | 9/2010 | Rees | 215/11.5 |
| 7,828,165 | B2 * | 11/2010 | Brown et al. | 215/11.4 |

* cited by examiner

*Primary Examiner* — Tri M Mai

(57) ABSTRACT

An improved bottle assembly consisting of a container 1100, a vent unit 1200, a nipple 1300, and collar 1400, wherein the vent unit 1200 geometry allows air to enter the assembly to prevent development of a partial vacuum, yet will not allow liquid to escape through said vent unit when assembly is rotated into a horizontal or inverted position during use.

8 Claims, 23 Drawing Sheets

VENTED NURSING BOTTLE WITH LEAK PREVENTION MEANS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of Invention

This invention generally relates to an improved vented nursing bottle, specifically the incorporation of a leak prevention feature into the bottle design.

2. Prior Art

Nursing bottles have been used for many years to feed babies, as a convenient alternative to breast feeding. This alternate method eliminates the discomfort often associated with breast feeding and allows care givers other than the maternal parent to perform this feeding. Moreover, the amount fed to the baby using this alternative can be accurately monitored.

Despite its numerous advantages however, there are several disadvantages. One significant disadvantage is the difficulty associated with dispensing the liquid from the bottle. As liquid is dispensed, a partial vacuum forms in the bottle, making further dispensing of liquid more difficult. Many prior art designs have sought to eliminate this disadvantage, with limited success. These prior art designs can be broadly categorized into two types: variable volume designs and vented designs. These are discussed in more detail in the paragraphs below.

A variable volume bottle design is one in which the volume of the container diminishes as the liquid is dispensed. One example of this design is disclosed in U.S. Pat. No. 4,880,125. As indicated therein, the design utilizes a collapsible bag set inside a rigid container, and replacement of the container bottom with a plunger which is depressed to reduce the effective bag volume as the liquid is dispensed. There are a number of weaknesses in this design however. First, inadvertent application of excess force to the plunger could result in dispensing liquid to the baby at a rate which exceeds the baby's consumption. This could cause the baby to gag or could result in spillage. In addition, collapsible liners are, by necessity, fragile and must be replaced frequently, making their use expensive. Also, handling and use of this design is difficult due to its cumbersome shape when assembled.

Another variable volume bottle design is disclosed in U.S. Pat. No. 6,616,000. As indicated therein, that design also incorporates a collapsible liner which must be replaced frequently. In addition, the liner assumes an irregular shape as it collapses during use, making it difficult to determine the quantity of liquid consumed by the baby.

Many vented bottle designs have been developed in the prior art to try to reduce or eliminate the development of a partial vacuum in the bottle during feeding. One example is disclosed in U.S. Pat. No. 6,742,665. As indicated therein, the venting apparatus consists of a spring loaded valve which is opened to allow air to enter the bottle. There are weaknesses associated with this design as well. These types of bottles are prone to leakage if foreign material becomes lodged in the valve seal, or if the valve is inadvertently opened when the bottle is not sufficiently inverted. In addition, use of a spring mechanism leads to additional expense in manufacturing.

Another vented bottle design is disclosed in U.S. Pat. No. 5,779,071. As indicated therein, venting apparatus is incorporated into the design and the geometry of this apparatus is intended to vent the bottle, yet not allow leakage through the vent path. However, this design is prone to significant leakage under certain conditions, as illustrated in FIGS. 1 through 6. Referring to FIGS. 1 and 2, this prior art design consists of a container 100, a vent unit 200, a nipple 300, and a collar 400. The vent unit 200 consists of a vent insert 210 and a reservoir tube 220. The container has a marking 103 which prescribes the maximum fill level of the container. FIG. 3 illustrates a cross section of the assembled prior art bottle, after being filled with liquid to the prescribed level and then rotated into a substantially horizontal orientation. In this figure, the light shading represents a liquid inside the container (container liquid) 500, and the dark shading represents a liquid inside the reservoir tube (reservoir liquid) 600. As illustrated in FIGS. 4 and 5, significant leakage can occur if pressure is applied to the nipple 300 while the bottle is in the horizontal position. This application of pressure is most often due to the baby chewing on the nipple. Referring to FIG. 4, pressure applied to the nipple 300 causes the container liquid 500 to be forced into the vent unit 200 and results in accumulation of additional reservoir liquid 601. Referring to FIG. 5, as pressure on the nipple 300 is relieved, air 602 is drawn out of the vent unit 200. Referring to FIG. 6, as pressure is then reapplied, additional liquid is forced into the vent unit 200. When the liquid level inside the vent unit 200 reaches the center of a vent insert 210, it will leak out of the bottle through the vent insert.

The weakness in prior art design disclosed in U.S. Pat. No. 5,779,071 is recognized in published application US 2005/0258124 A1. As indicated therein, the weakness is addressed by changing the shape of the bottle and limiting the quantity of liquid to be contained therein such that the vent insert is never submerged. This new design has a number of disadvantages however. First, the oversized shape of the bottle will be difficult for a baby to hold. Second, the design significantly limits the quantity of liquid which can be placed in each bottle, potentially resulting in the need to use multiple bottles to administer an adequate feeding.

Another prior art design of this type is disclosed in U.S. Pat. No. 5,570,796. This design also utilizes a reservoir tube and vent insert, but must be oriented with the reservoir tube and vent insert facing upward to prevent leakage.

OBJECTS AND ADVANTAGES

The object of the present invention is to provide an improved bottle design which is fully vented, eliminates the potential for leakage described in the paragraphs above, is easy to clean, and does not require that the bottle be used in a specific orientation.

BRIEF SUMMARY OF THE INVENTION

The present invention incorporates a vent unit inside a container which allows air to enter the container but will not allow liquid to escape. The vent unit includes a flexible element and a buoyant element which ensure that the end of the vent unit is not submerged when the bottle is in a substantially horizontal orientation. If pressure is applied to the nipple in this orientation, air rather than liquid is forced into the vent unit. Therefore, liquid will not accumulate into and leak out of the vent unit. Since this design relies on forces due to buoyancy which always act in the upward direction to keep the end of the vent unit from being submerged, the new design will prevent leakage regardless of its orientation.

DETAILED DESCRIPTION OF THE INVENTION

FIGS. 7 through 11

Preferred Embodiment

The preferred embodiment of the present invention is illustrated in FIGS. 7 through 11. As indicated therein, it consists of a container 1100, a vent unit 1200, a nipple 1300, and a collar 1400. The container 1100 has a circular open top 1101, threads 1102 to engage the collar 1400, and a marking 1103 to indicate the maximum fill level of the container.

Figure 8:
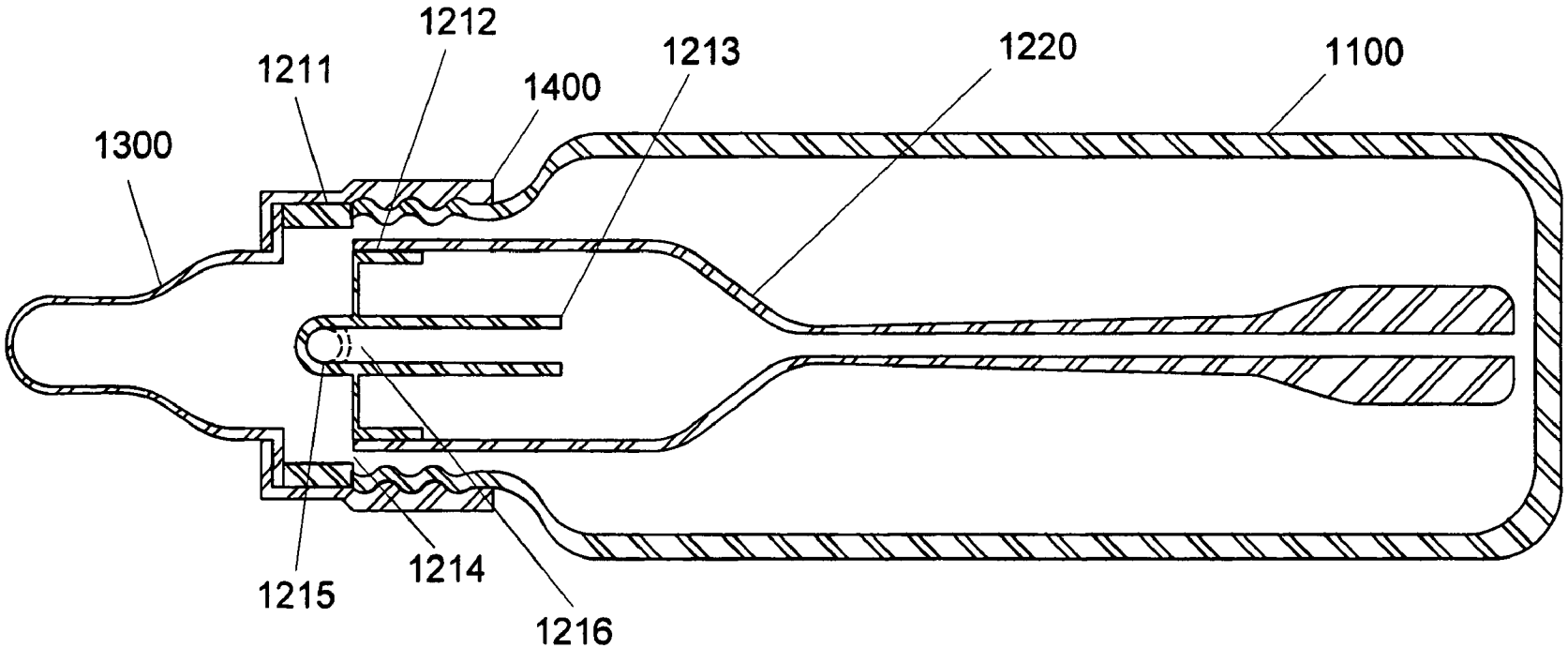
FIG. 8 is a sectional view of the preferred embodiment of the present invention, taken along line 8-8 of FIG. 7.
Figure 9:
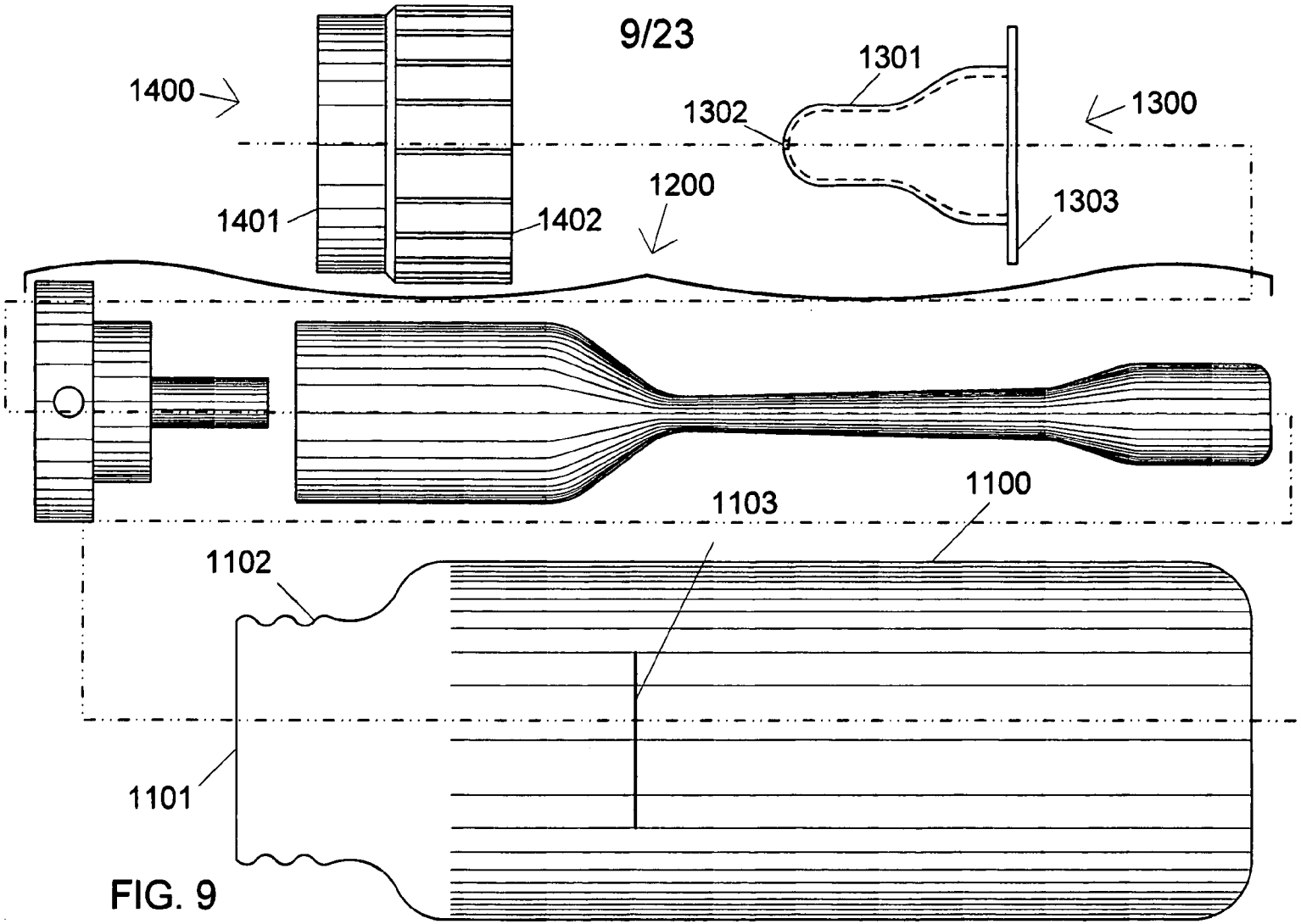
FIG. 9 is an exploded side view of the individual parts of the preferred embodiment of the present invention.
Figure 10:
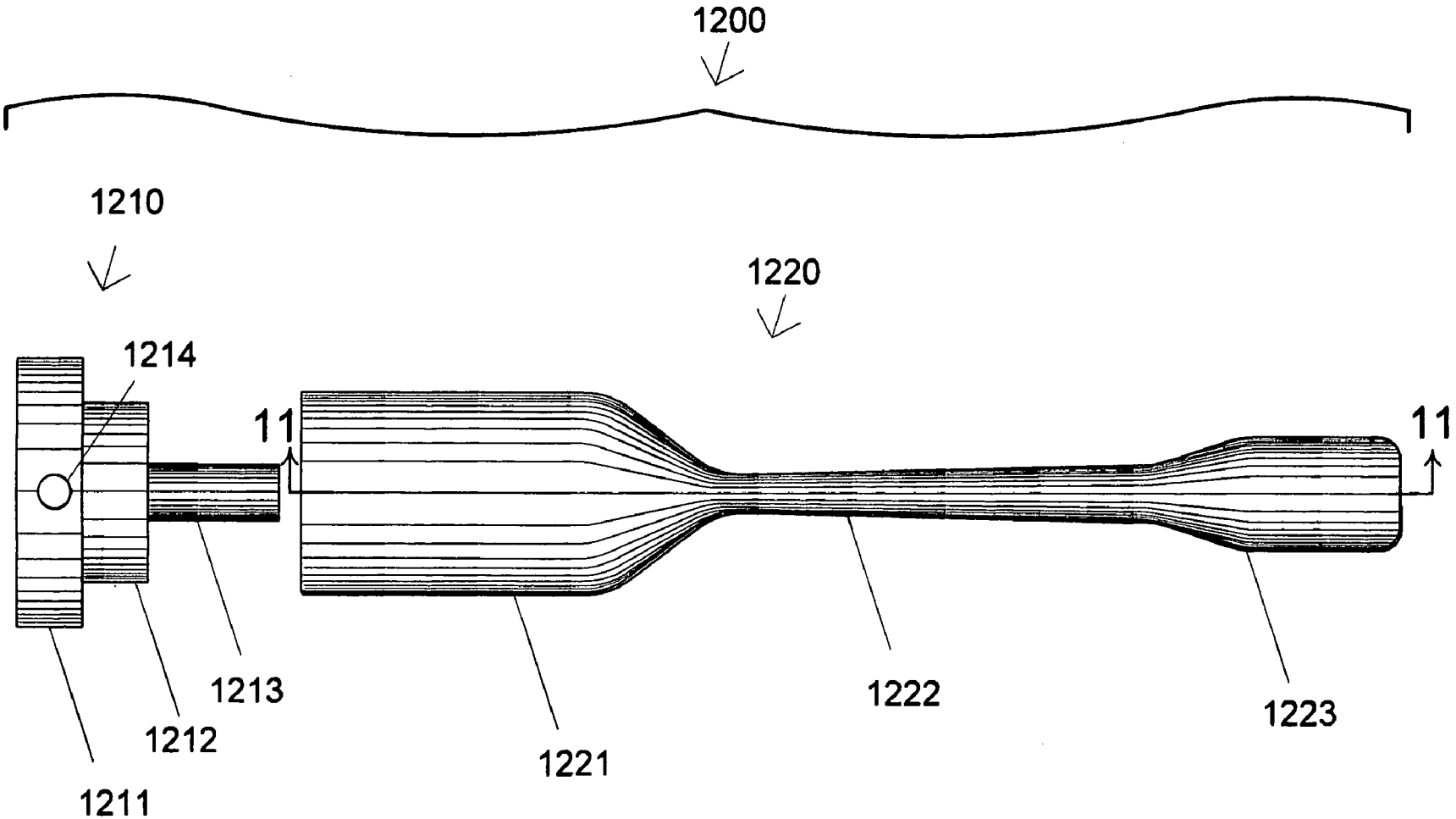
FIG. 10 is an exploded side view of the vent unit of the preferred embodiment of the present invention.

As indicated in FIG. 10, the preferred embodiment of the vent unit 1200 is composed of two distinct elements: a vent insert 1210 and a reservoir tube 1220. The vent insert 1210 consists of a flange 1211, a shoulder 1212, and a vent tube 1213. The flange 1211 is circular, with an outside diameter substantially equal to the outside diameter of the container top 1101. As best illustrated in FIG. 8, the interface between the flange 1211 and shoulder 1212 has at least one opening 1214 to allow the passage of liquids. The flange 1211 also incorporates a passage 1215 which starts on the side of the flange 1211, runs radially to the center of the flange and ends on its underside. As best illustrated in FIG. 8, the shoulder 1212 of the preferred embodiment is circular, with a central opening 1216 aligned with the flange passage 1215. The vent tube 1213 is a circular hollow tube aligned with the central opening 1216 of the shoulder 1212.

Figure 11:
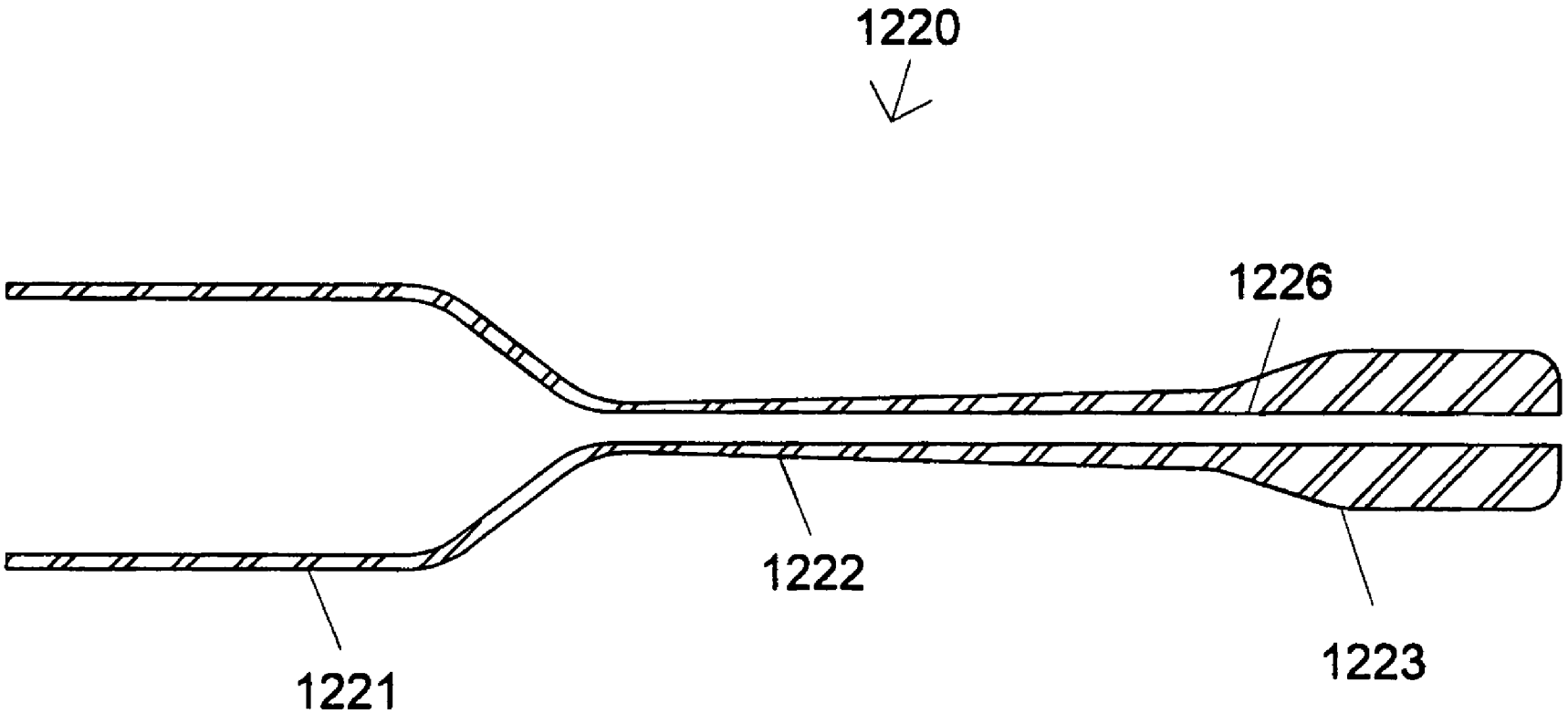
FIG. 11 is a sectional view of the reservoir tube of preferred embodiment.

As best illustrated in FIG. 11, the reservoir tube 1220 of the preferred embodiment is a homogeneous element consisting of a reservoir 1221, a stem 1222, and a float 1223. These elements of the reservoir tube 1220 are hollow and of circular cross section, creating a central opening 1226. The reservoir 1221 wall is relatively thin, and its inside diameter is sized to fit tightly over the shoulder 1212 of the vent insert 1210. The stem 1222 wall is also relatively thin, and its inside diameter is significantly smaller than the inside diameter of the reservoir 1222. The float 1223 wall is relatively thick, and its inside diameter is substantially equal to the inside diameter of the stem 1222. The overall length of the reservoir tube 1220 is sized so that the bottom of the tube is in close proximity to the bottom of the container 1100 when the elements are assembled. The inside volume of the reservoir 1221 is sized so that a volume of liquid equal to the inside volume of the stem 1222 plus the float 1223 contained inside the reservoir 1221 could not submerge the lower end of the vent tube 1213 regardless of the spatial orientation of the reservoir tube 1220 when the elements are assembled. The preferred embodiment of the reservoir tube 1220 is constructed from a flexible and buoyant closed cell foam rubber material. The degree of flexibility and buoyancy required for this material will become apparent in the discussion of the operation of the preferred embodiment which is presented below.

The nipple 1300 of the preferred embodiment is conventional in design. It is constructed from a flexible synthetic rubber and includes a nipple body 1301 with a central hole 1302, and a nipple flange 1303. The flange is circular with an outside diameter substantially equal to the outside diameter of the vent insert flange 1211 and container top 1101.

The collar 1400 of preferred embodiment is also of conventional design. It is constructed of hard plastic and includes an upper portion 1401 and a lower portion 1401. The upper portion 1401 is sized to accommodate the thickness of the vent insert flange 1211 and the nipple flange 1303 when assembled, as best illustrated in FIG. 8. The lower portion 1401 is designed to engage with the container threads 1102 and develop sufficient force when engaged to make an effective seal at the nipple/vent insert and vent insert/container interfaces.

FIGS. 12 through 15

Operation of Preferred Embodiment

Figure 12:
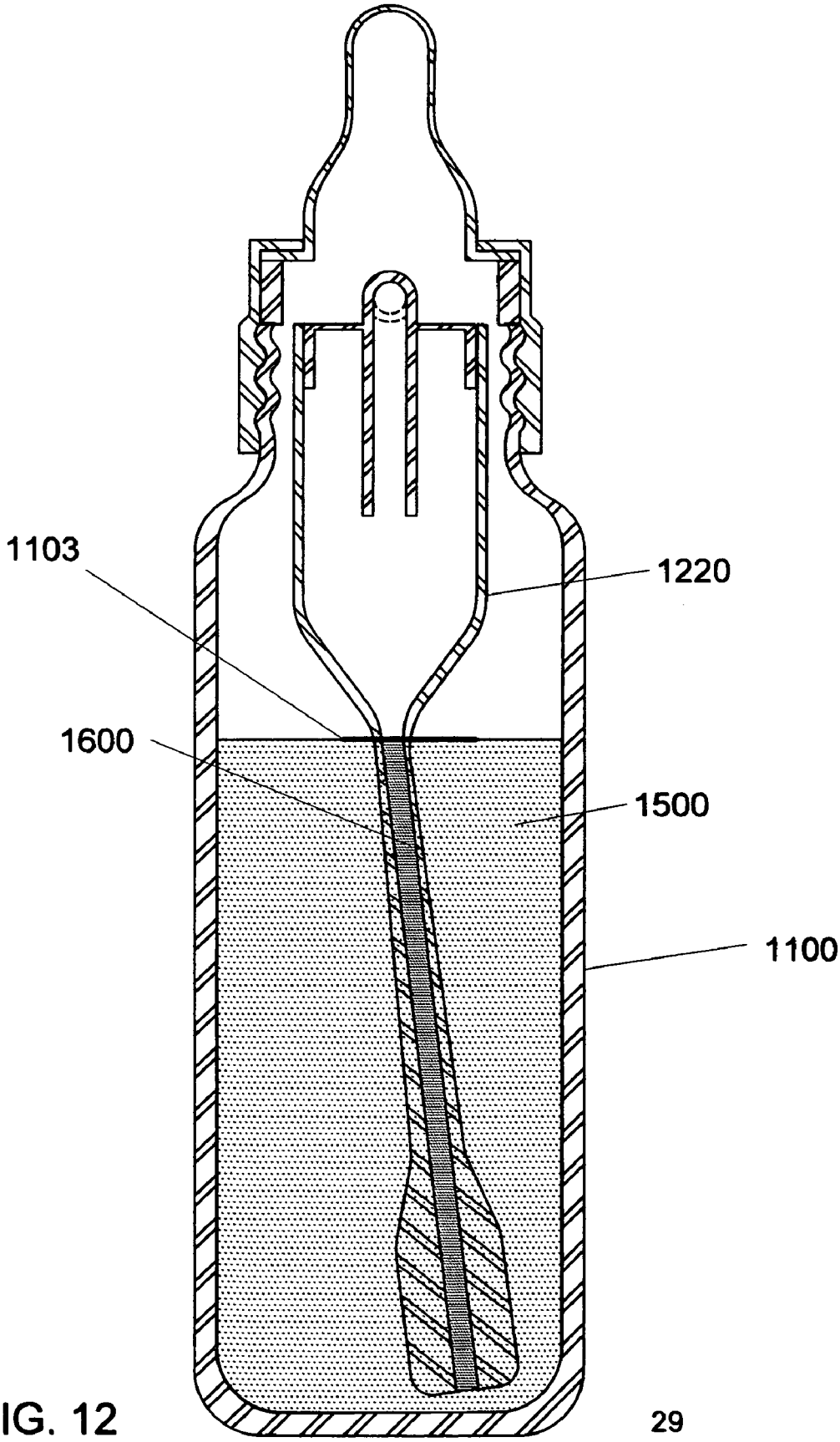
FIG. 12 is a sectional view of the preferred embodiment filled with liquid to a prescribed level in an upright position.
Figure 13:
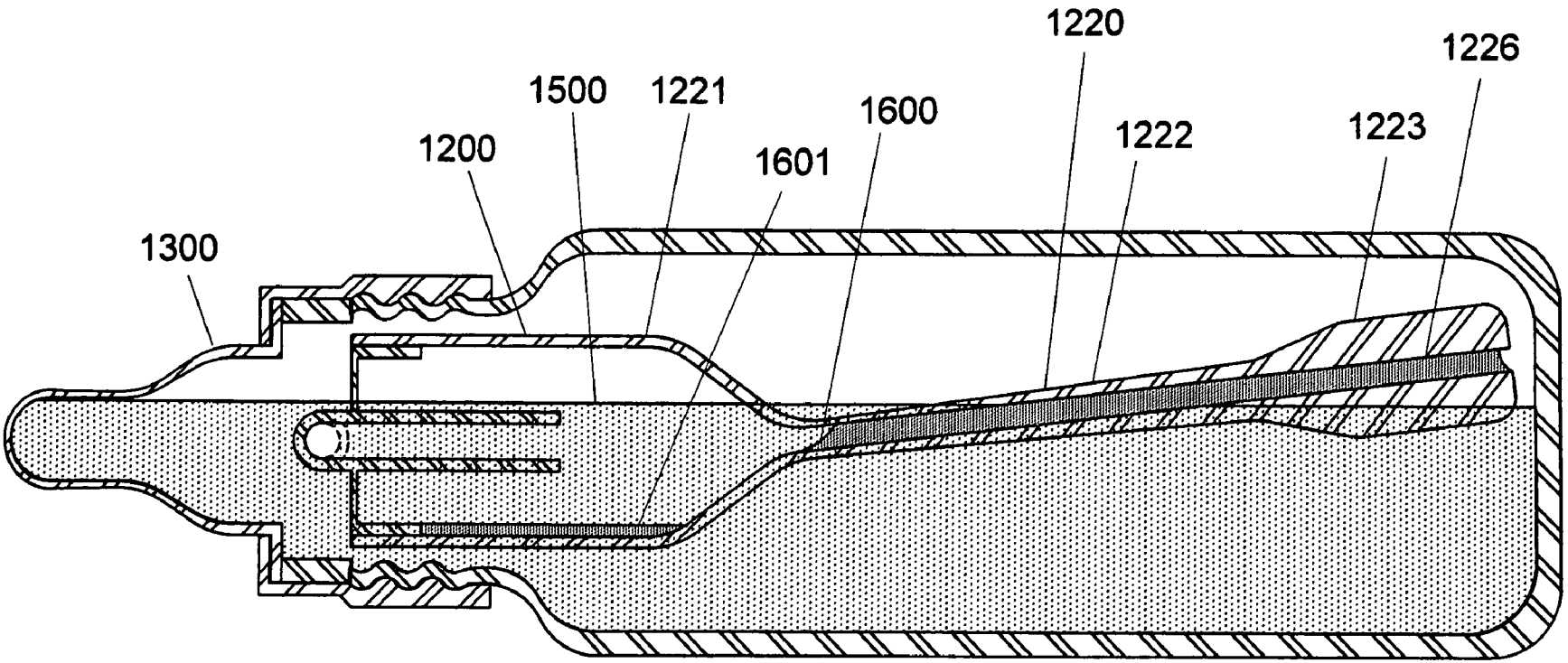
FIG. 13 is a sectional view of the preferred embodiment filled with liquid to a prescribed level, then rotated into a substantially horizontal position.
Figure 14:
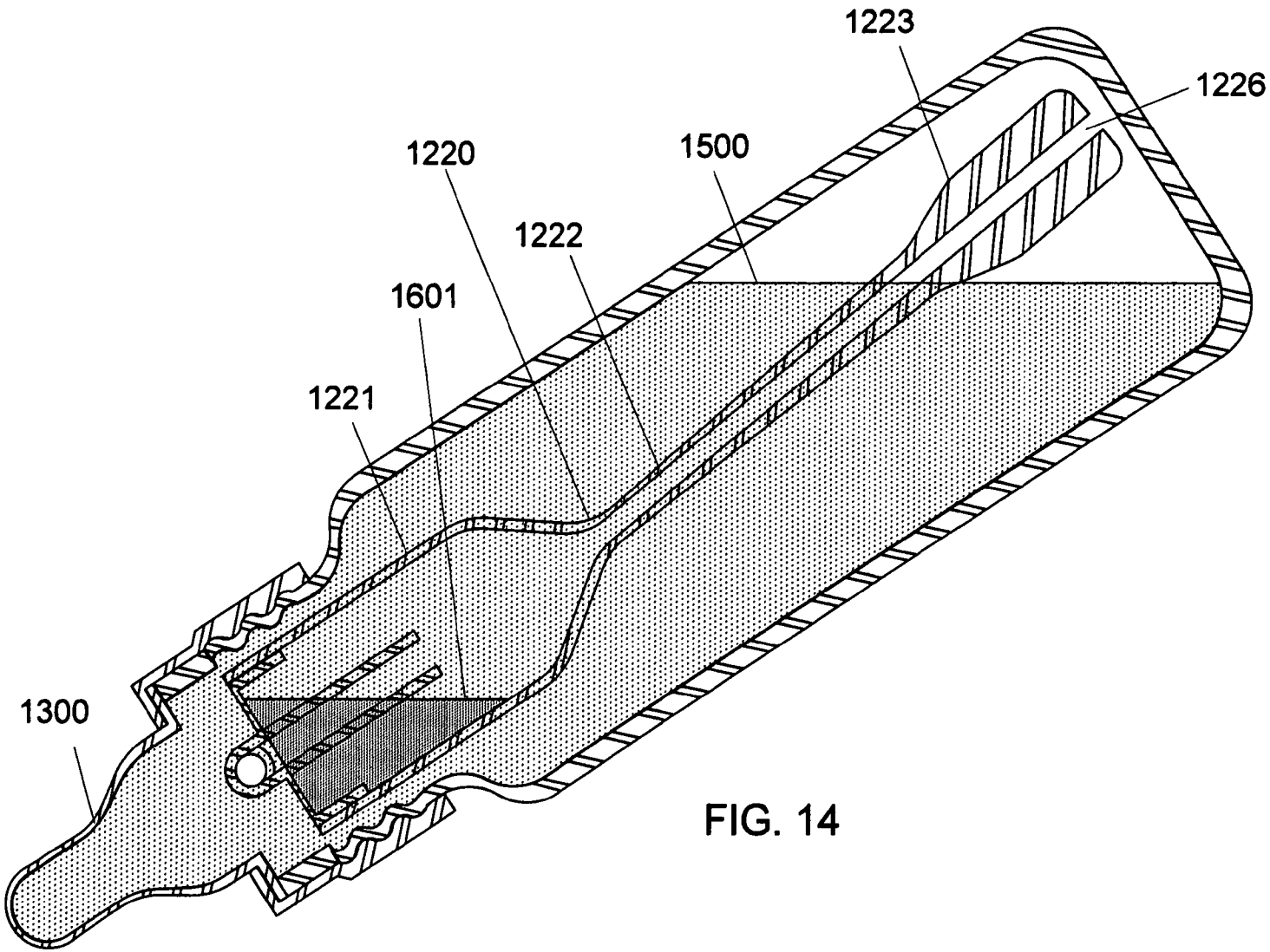
FIG. 14 is a sectional view of the preferred embodiment filled with liquid to a prescribed level, then rotated into an inverted position.
Figure 15:
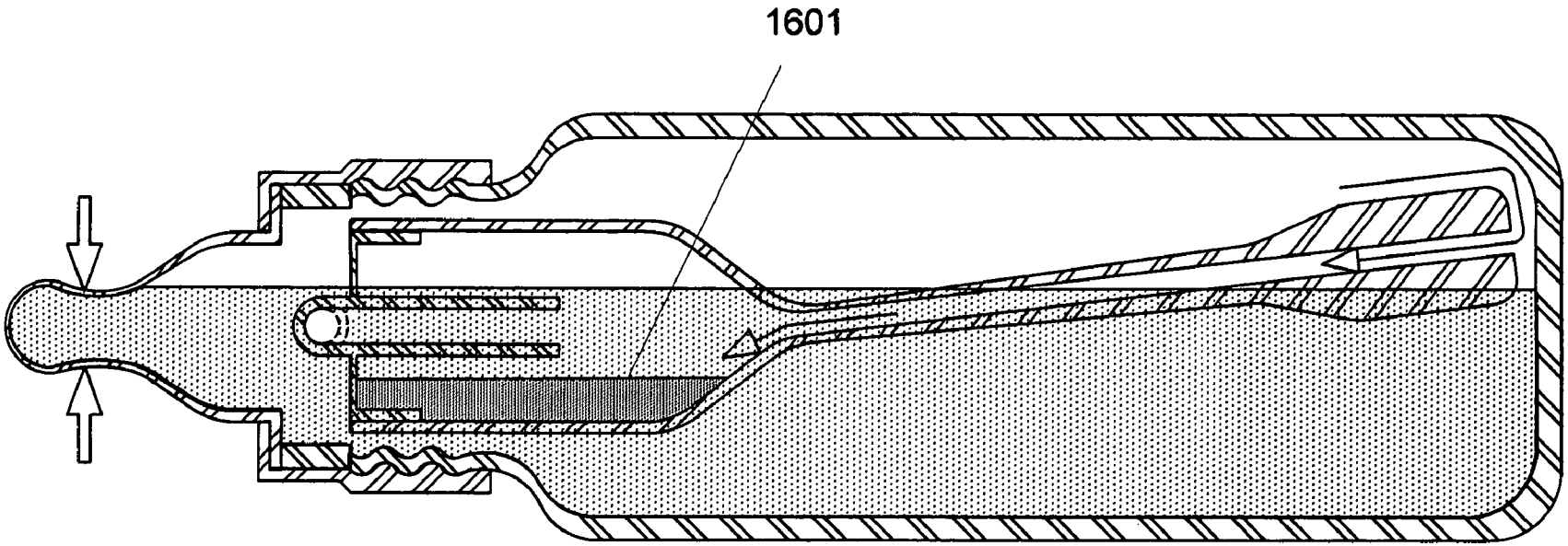
FIG. 15 is a sectional view of the preferred embodiment filled with liquid to a prescribed level, rotated into a substantially horizontal position, showing the effect of applying pressure to the nipple.

Operation of the preferred embodiment of the present invention is illustrated in FIGS. 12 through 15. As indicated in FIG. 12, the container 1100 is filled with liquid 1500 until the level reaches the marking 1103. Some of this liquid (reservoir liquid) 1600 flows up into the reservoir tube 1220 also up to the level of the marking 1103. The bottle is then fully assembled as shown. To use the filled and assembled bottle, it is rotated into a substantially horizontal position as shown in FIG. 13, or an inverted position as shown in FIG. 14. In the horizontal position, the flexibility and buoyancy of the reservoir tube 1220 causes its bottom to float so that the bottom of the central opening 1226 is above the level of the container liquid 1500. While in either horizontal or inverted, the reservoir liquid 1600 may stay within the stem 1222 or float 1223 due to adhesive forces between the liquid and the stem/float material (as shown in FIG. 13), or may migrate into the reservoir 1221 due to gravity (as shown in FIG. 14). The application of pressure to the nipple 1300 pressurizes the inside of the container and will also cause the reservoir liquid 1600 to be forced into the reservoir, as shown in FIG. 15. Once emptied, no additional liquid can enter the central opening 1226 while in a horizontal or inverted position since the bottom of the central opening 1226 is above the container liquid level. And since the reservoir 1221 volume has been specifically sized, this reservoir liquid 1601 cannot enter the vent tube 1213 regardless of the orientation of the bottle assembly. Due to these unique combination of features, liquid cannot enter into and escape from the vent insert when the bottle is in a substantially horizontal or inverted orientation.

FIGS. 16 through 23

Alternate Embodiments

Figure 16:
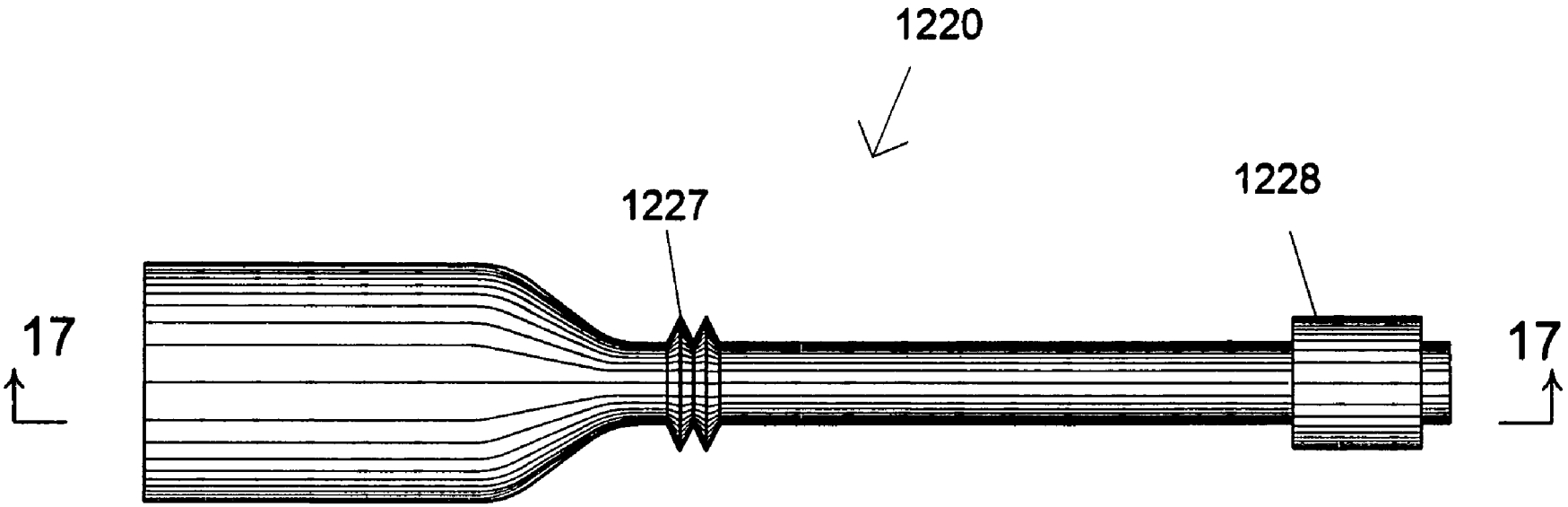
FIG. 16 is a side view of a first alternate embodiment of the improved reservoir tube.
Figure 17:
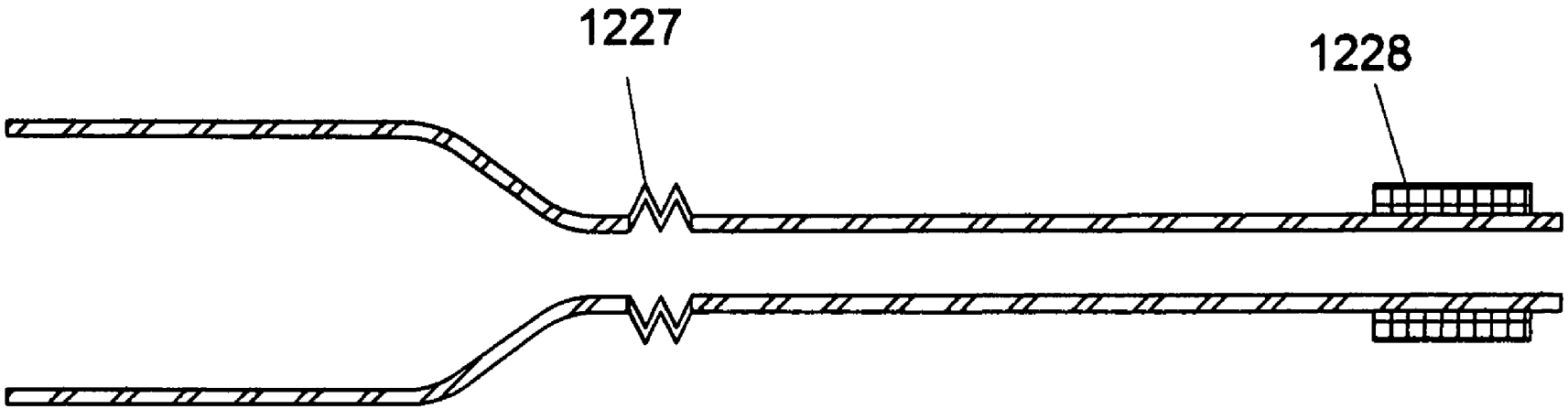
FIG. 17 is a sectional view of the first alternate embodiment of the improved reservoir tube, taken along line 17 of FIG. 16.
Figure 18:
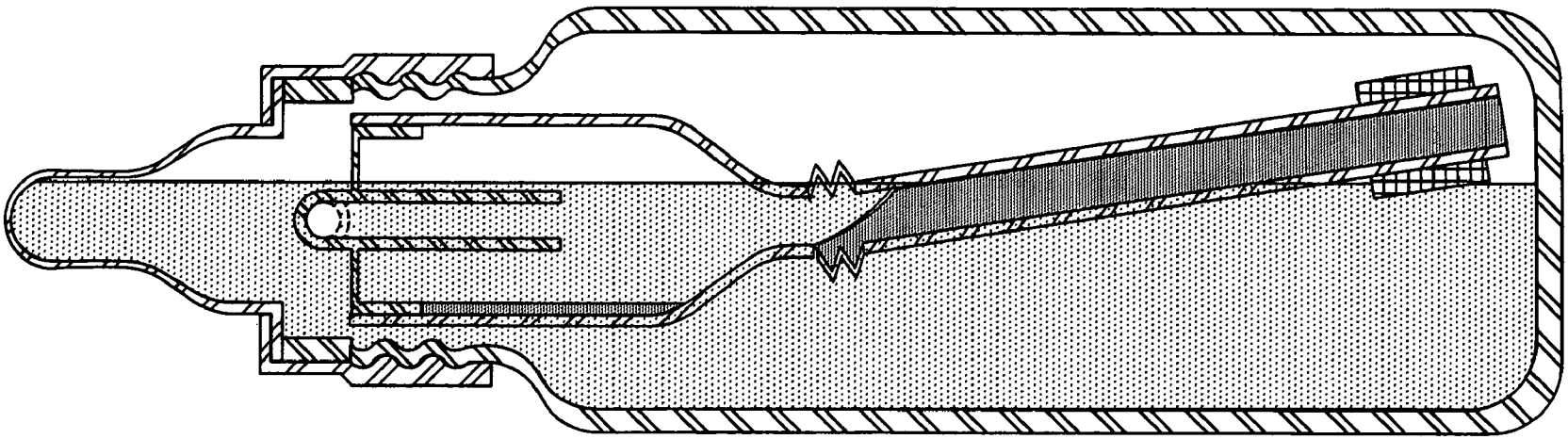
FIG. 18 is a sectional view of the first alternate embodiment incorporated into the improved bottle assembly, rotated into a substantially horizontal orientation.

A number of alternate embodiments of the present invention are possible. A first alternate embodiment is illustrated in FIGS. 16 through 18. As indicated therein, the reservoir tube 1220 could incorporate a distinct flexible element 1227 in lieu of constructing the entire tube from flexible material. In addition, the tube 1220 could incorporate a distinct buoyant element 1228 in lieu of constructing the entire tube from a buoyant material. As illustrated in FIG. 18, the distinct flexible element 1227 and buoyant element 1228 would be sized so that the bottom of the vent unit 1200 is above the water level when in a substantially horizontal configuration.

Figure 19:
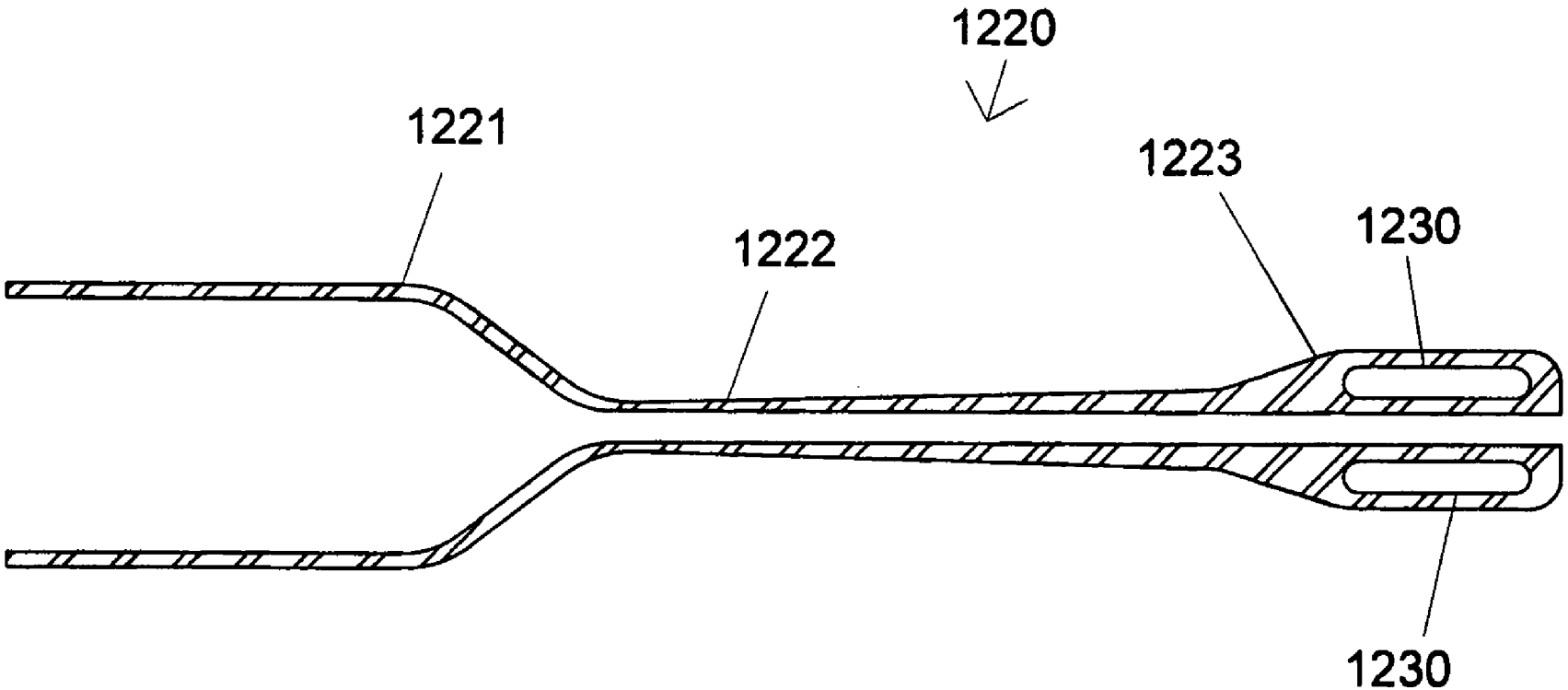
FIG. 19 is a sectional view of a second alternate embodiment of the improved reservoir tube.

A second alternate embodiment is illustrated in FIG. 19. As indicated therein, an air pocket 1230 can be incorporated into the float 1223 to increase buoyancy. The inclusion of this air pocket 1230 could be in lieu of or in addition to constructing entire vent tube 1220 from buoyant material.

A third alternate embodiment (not shown) could incorporate the vent insert 1210 and reservoir tube 1220 into a single element. Likewise, a fourth alternate embodiment (not shown) could incorporate the nipple 1300 and collar 1400 into one element.

Figure 23:
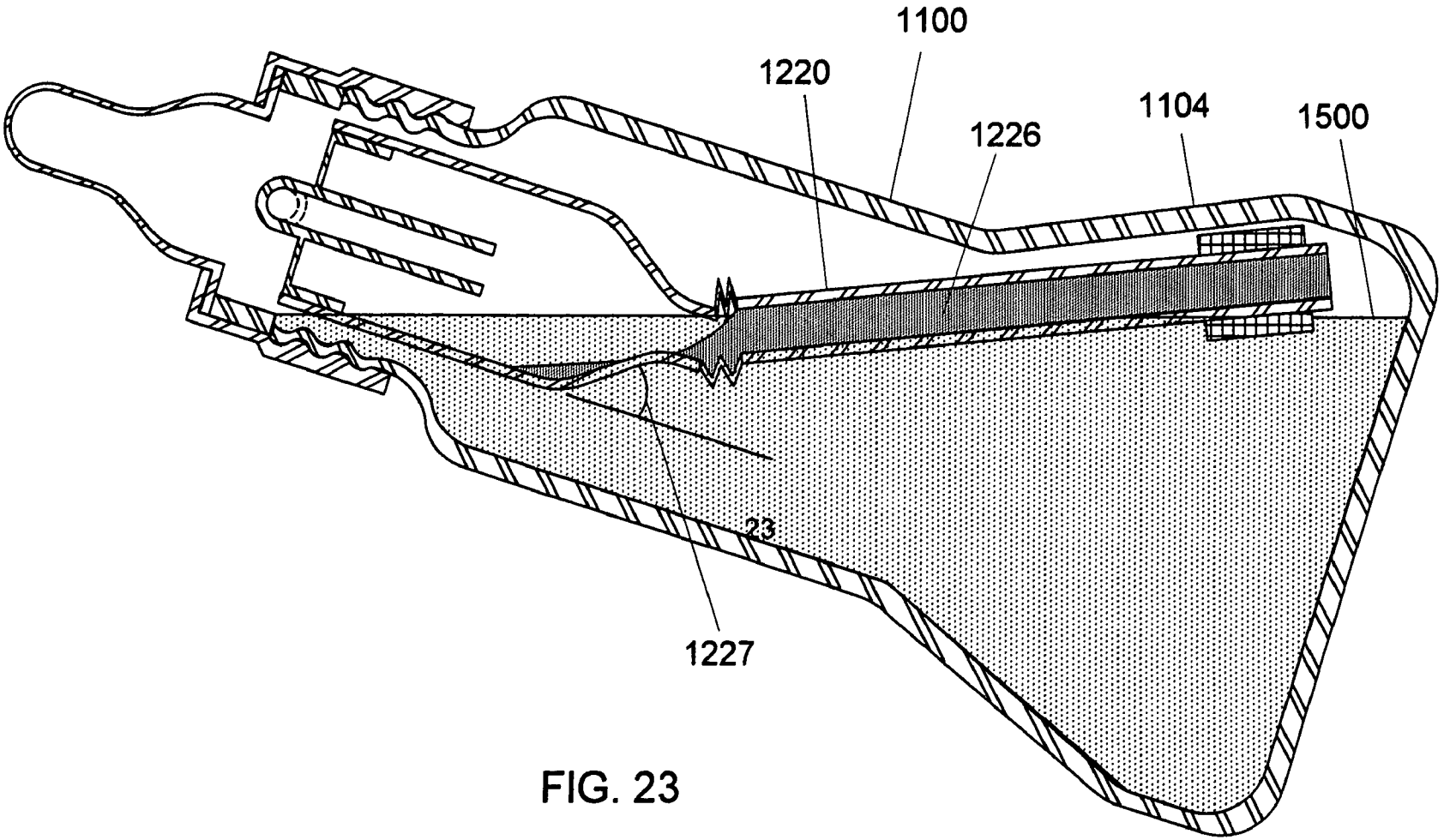
FIG. 23 is a sectional view of a fifth alternate embodiment of the present invention.

A fifth alternate embodiment is illustrated in FIG. 23. In this embodiment, the shape of the container 1100 is altered to include a widened portion 1104. In addition, this embodiment incorporates a specific taper 1227 into the reservoir tube 1220. The required dimensions of the widened portion 1104 and taper 1227 will become apparent in the discussion of the operation of the alternate embodiments which is presented below.

FIGS. 18 through 23

Operation of Alternate Embodiments

The operation of the alternate embodiments is substantially identical to the operation of the preferred embodiment. The bottle is assembled, filled to a prescribed level, and used for feeding. Due to the improvements made to reservoir tube 1220, the bottle can be used in a substantially horizontal or inverted orientation, and pressure can be applied to the nipple, such as from chewing, without resulting in leakage.

Figure 1:
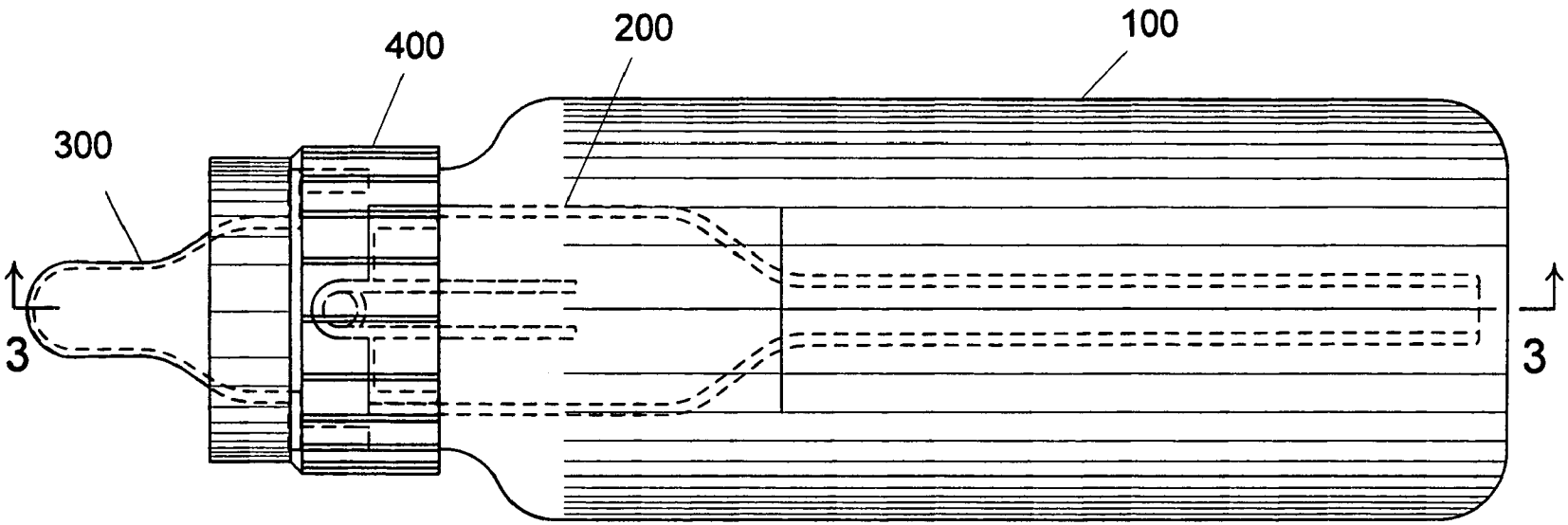
FIG. 1 Prior Art
FIG. 1 is a side view of a prior art bottle assembly.
Figure 2:
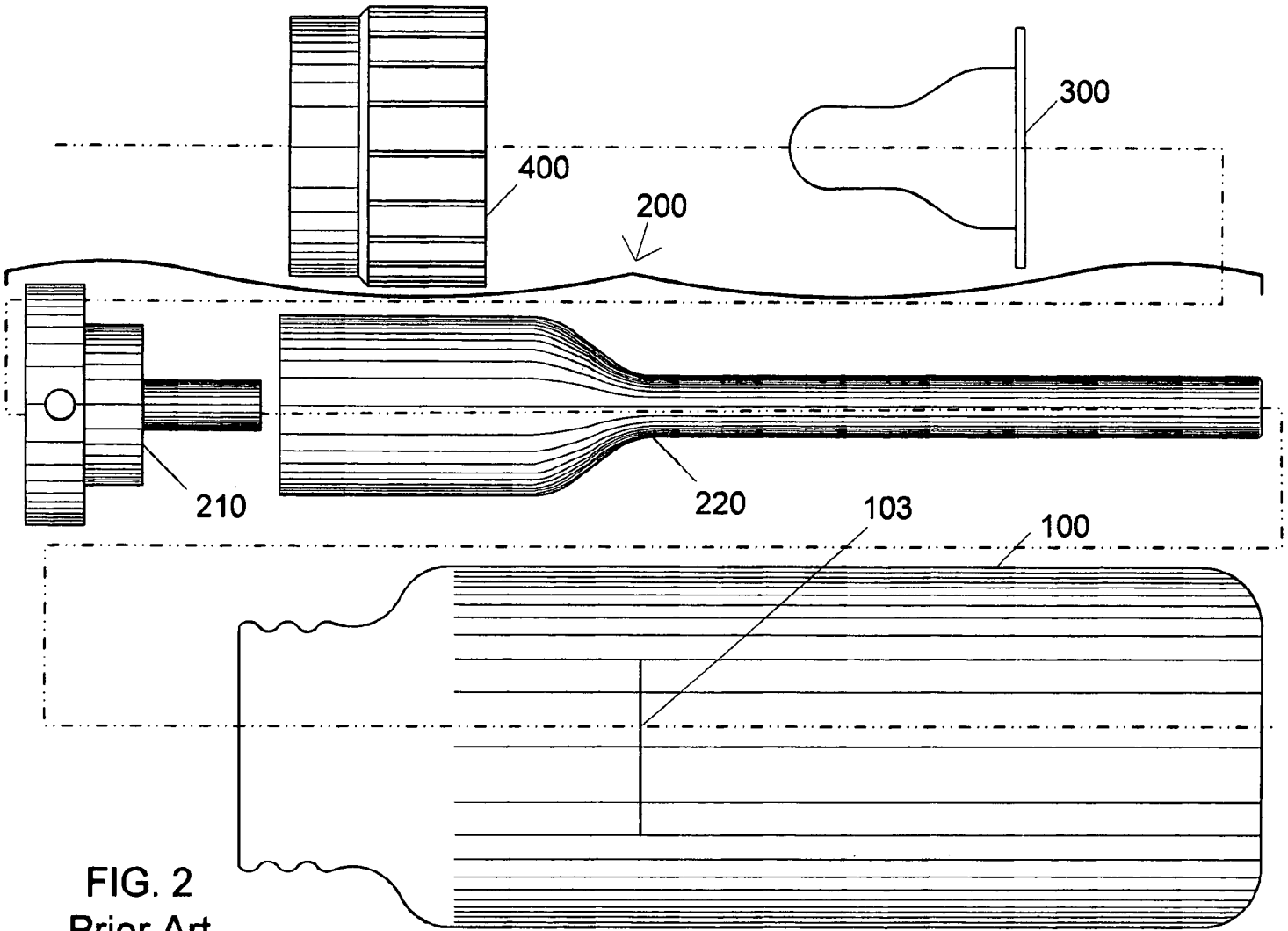
FIG. 2 Prior Art
FIG. 2 is an exploded side view of the individual parts disclosed in the prior art design illustrated in FIG. 1.
Figure 3:
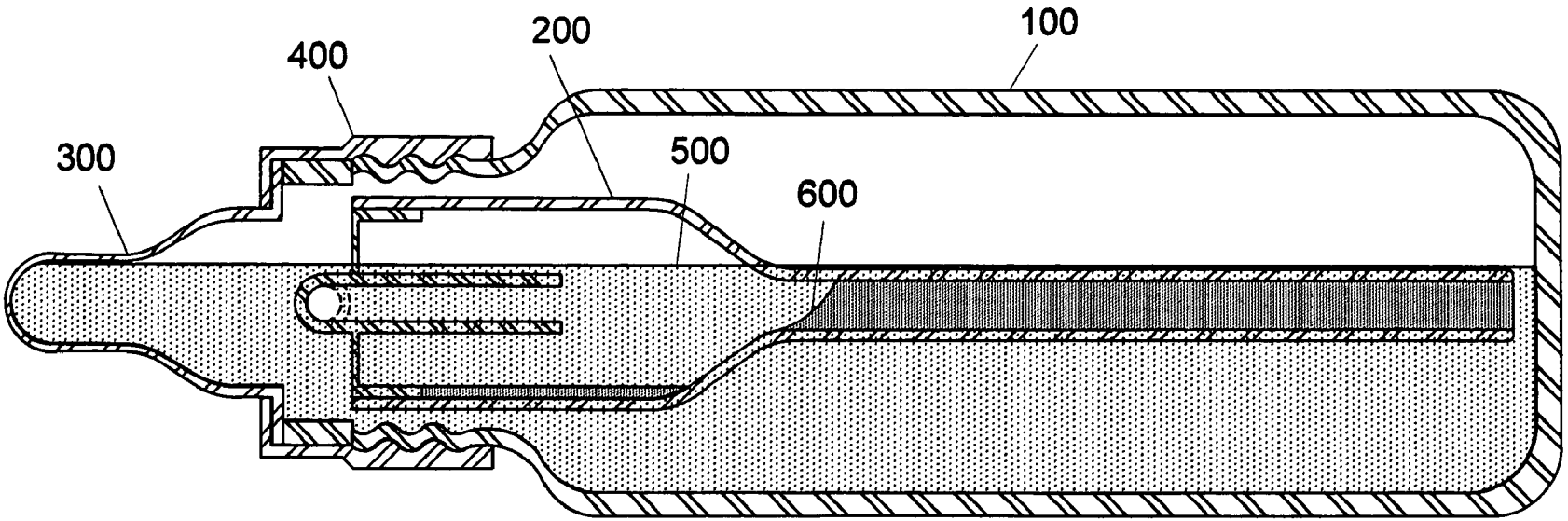
FIG. 3 Prior Art
FIG. 3 is a sectional view of the prior art design, taken along line 3-3 of FIG. 1, and filled with liquid to a prescribed level.
Figure 4:
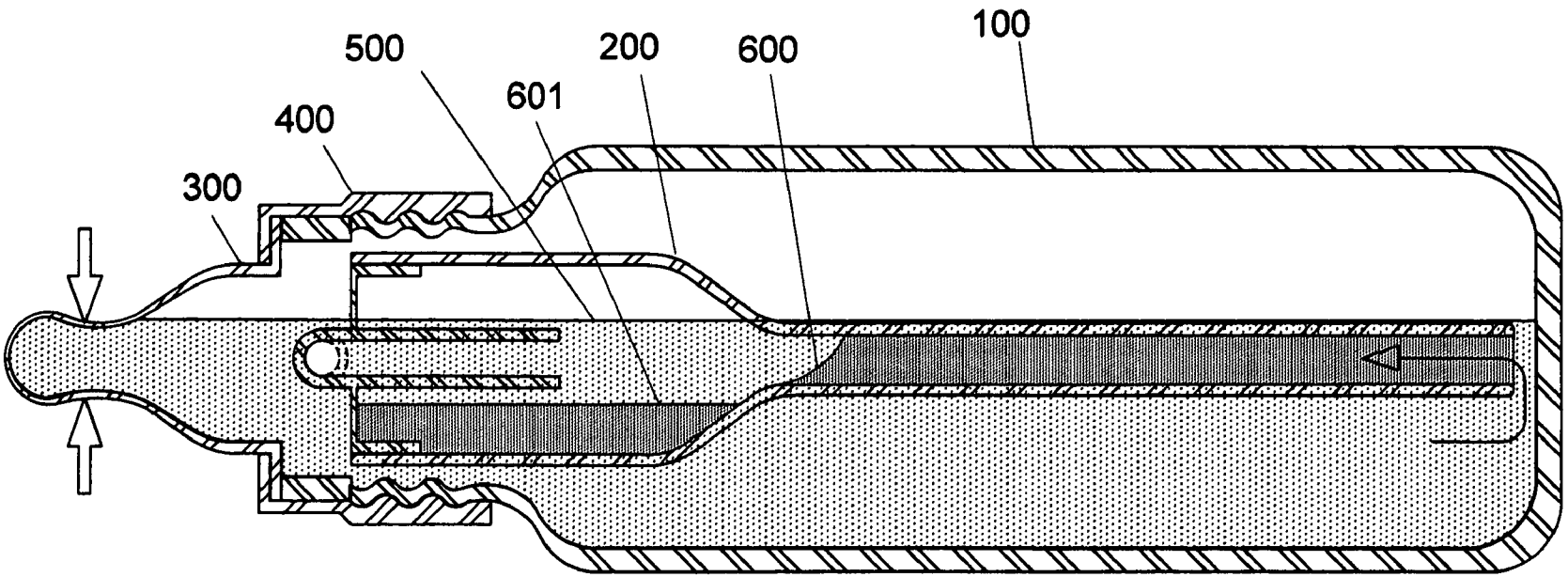
FIG. 4 Prior Art
FIG. 4 is a sectional view of the prior art design illustrating the consequences of initially pressurizing the nipple.
Figure 5:
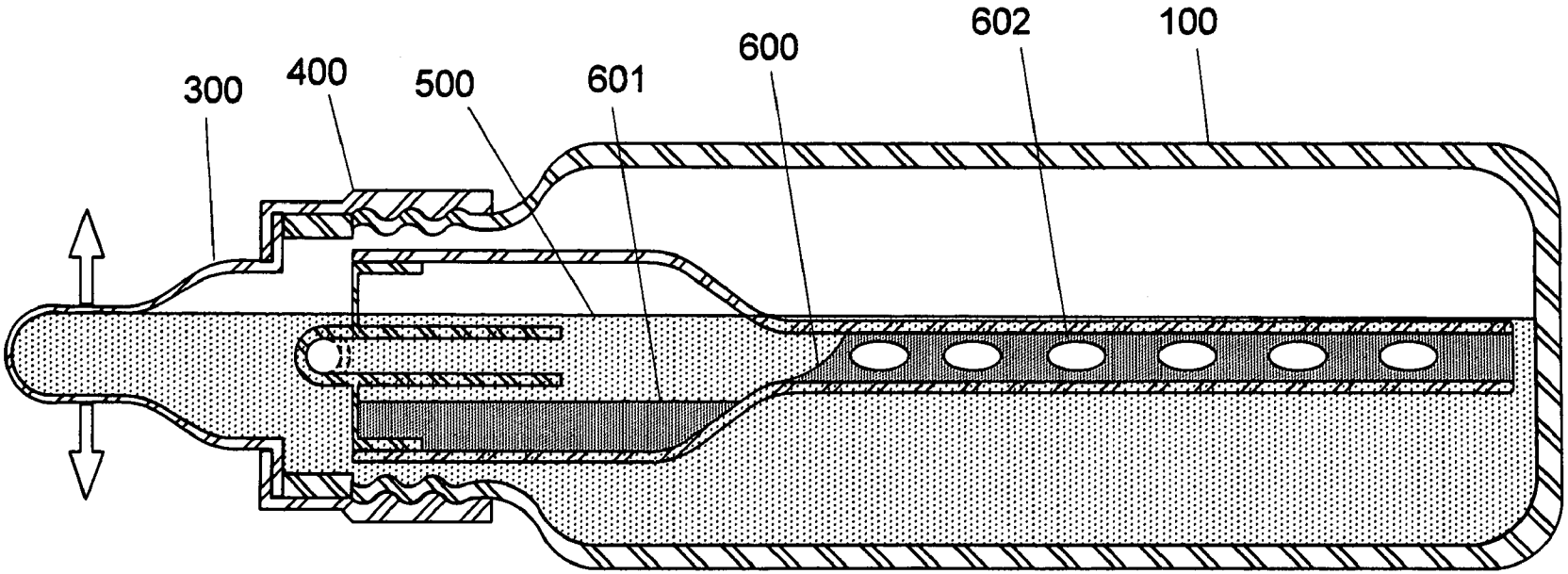
FIG. 5 Prior Art
FIG. 5 is a sectional view of the prior art design illustrating the effect of relieving the pressure on the nipple.
Figure 6:
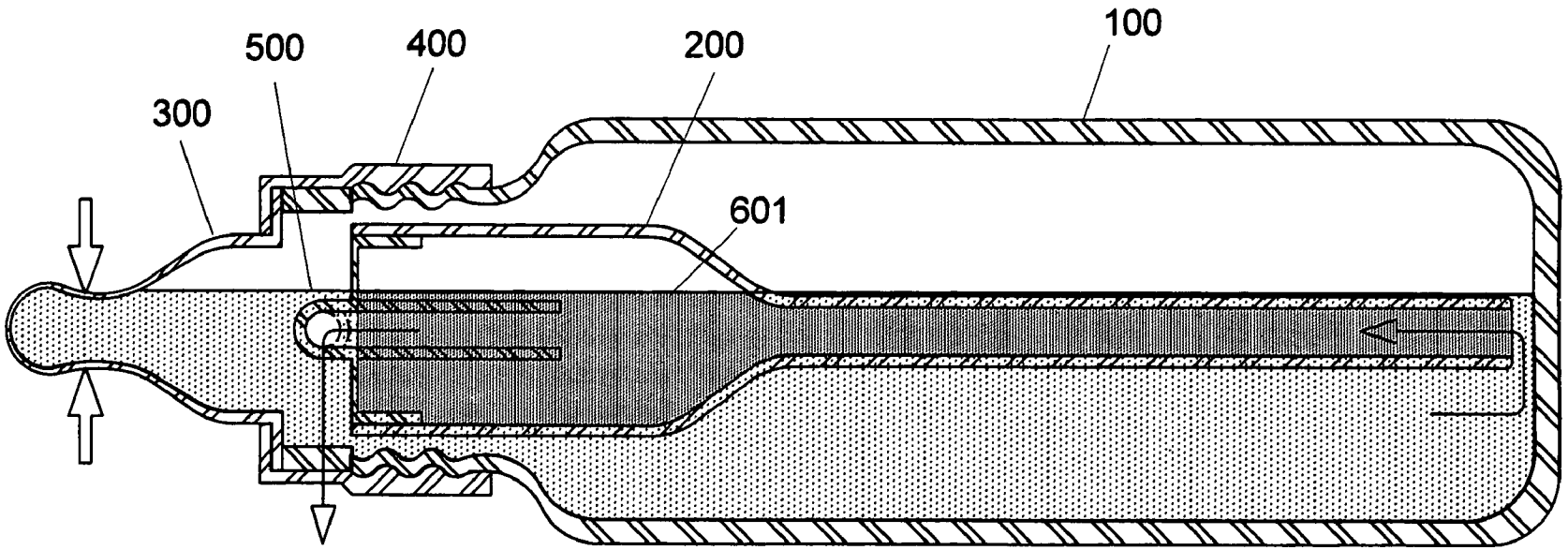
FIG. 6 Prior Art
FIG. 6 is a sectional view of the prior art design illustrating the leakage path resulting from re-pressurizing the nipple.
Figure 7:
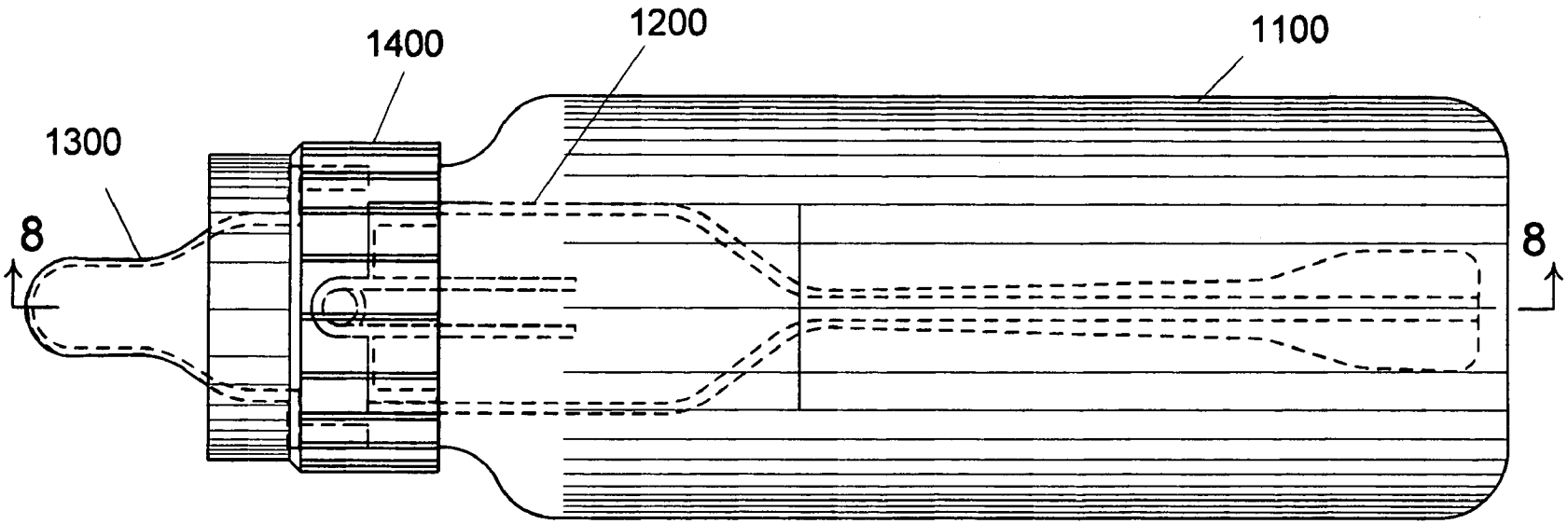
FIG. 7 is a side view of the preferred embodiment of the present invention.
Figure 20:
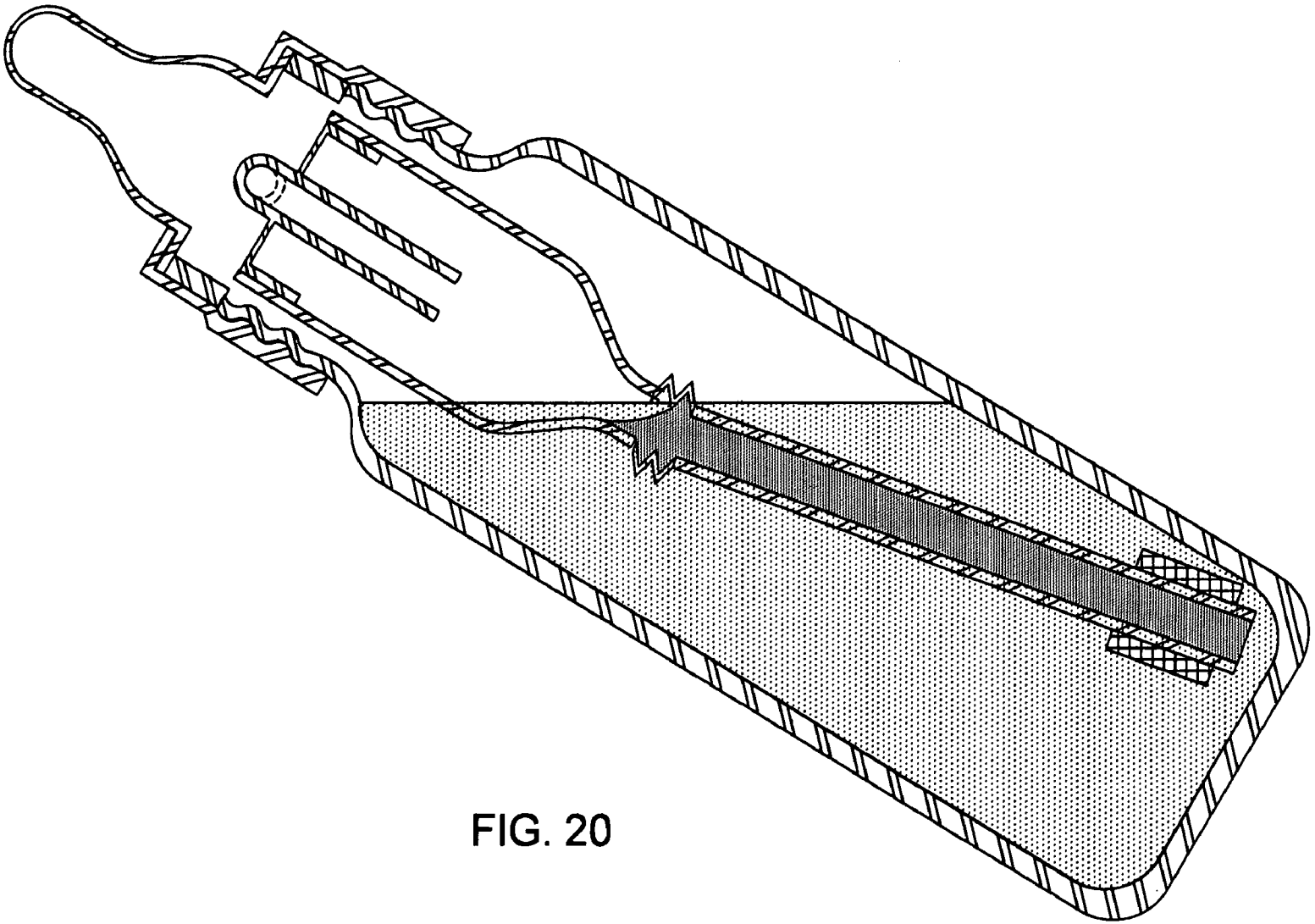
FIG. 20 is a sectional view of the first alternate embodiment incorporated into the improved bottle assembly, rotated into a position less than horizontal.
Figure 21:
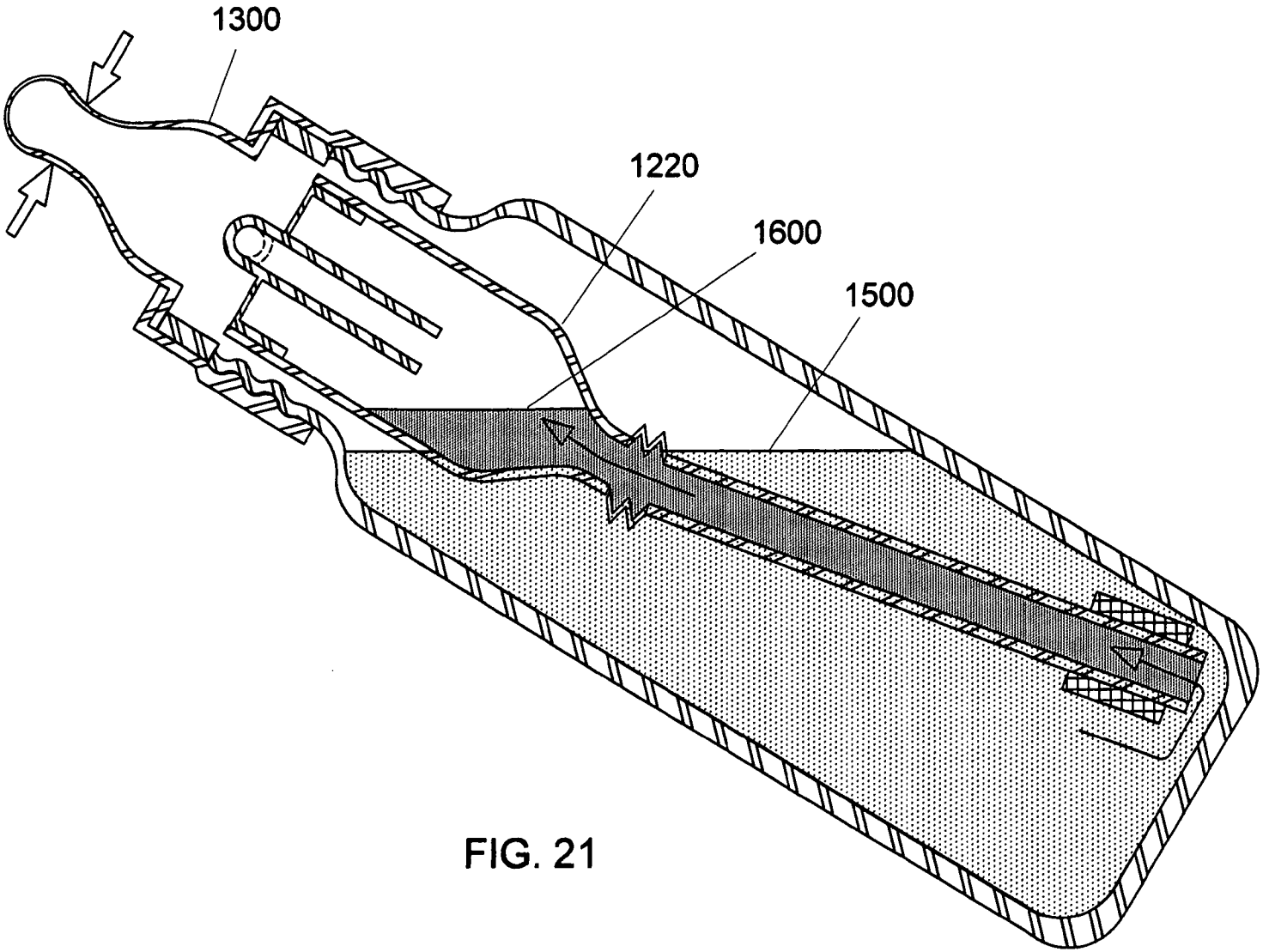
FIG. 21 is a sectional view of the first alternate embodiment incorporated into the improved bottle assembly, rotated into a position less than horizontal, showing the effect of pressurizing the nipple.
Figure 22:
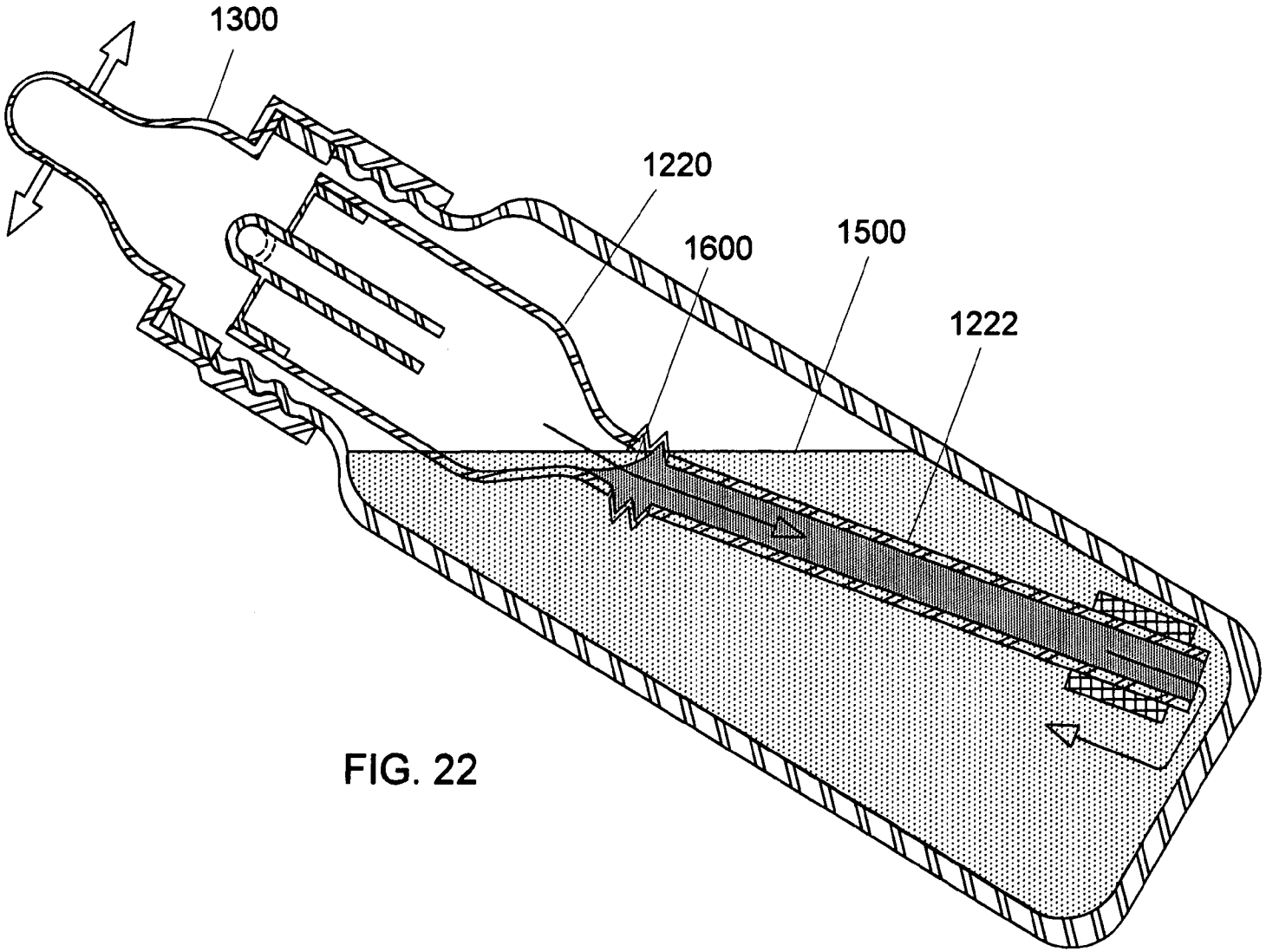
FIG. 22 is a sectional view of the first alternate embodiment incorporated into the improved bottle assembly, rotated into a position less than horizontal, showing the effect of relieving pressure applied to the nipple.

In the fifth alternate embodiment illustrated in FIG. 23, the inclusion of the widened portion 1104 of the container 1100 and the taper 1227 on the reservoir tube 1220 is intended to further improve the leak resistance of the bottle assembly when rotated into a position less than substantially horizontal. Explanation of the benefit of these additional elements is provided below with the aid of FIGS. 20 through 23. FIG. 20 illustrates a bottle assembly rotated into an orientation less than horizontal. FIG. 21 illustrates the effect of applying pressure to the nipple 1300 when the assembly is in this orientation. As indicated, container liquid 1500 is forced into the reservoir tube 1220. FIG. 22 illustrates the effect of releasing the pressure from the nipple 1300. As the nipple 1300 returns to its normal shape, reservoir liquid 1600 which was forced into reservoir tube 1220 is pulled back out due to a partial vacuum formed by the nipple regaining its normal shape. Reservoir liquid 1600 is forced back out rather than air bubbles as illustrated in FIG. 5 because liquid, rather than air is adjacent to the central opening 1226 in the stem 1222. Therefore, liquid does not accumulate in the reservoir 1221 with successive applications of pressure to the nipple 1300 as it does with the prior art design in a horizontal position. FIG. 23 illustrates a bottle assembly rotated into a position closer to horizontal than FIGS. 20 through 22. As indicated, this bottle assembly incorporates a widened portion 1104 of the container 1100 and a taper 1227 in the reservoir tube 1220. Because of the widened portion 1104, the bottom of the central opening 1226 of the reservoir tube 1220 is free to float above the liquid level. If the bottle assembly was to be rotated counter-clockwise towards and beyond horizontal from the position shown in FIG. 23, the bottom of the central opening 1226 would remain above the liquid level, and thus, any pressure applied to the nipple could not allow accumulation of liquid in the reservoir 1221 resulting in leakage, since only the liquid in the central opening 1226 could flow into the reservoir 1221. Alternately, if the bottle assembly was to be rotated clockwise back toward vertical from the position shown in FIG. 23, and pressure was applied to the nipple, liquid would first enter, but then be forced back out of the reservoir 1221 as the pressure is relieved since the geometry (including the taper 1227) ensures that liquid, rather than air, is adjacent to the central opening 1226 in the stem 1222. Thus, regardless of angular orientation, liquid cannot leak from the bottle. It should be noted that the likelihood that the bottle assembly would be held in the orientation illustrated in FIG. 23 (i.e. less than horizontal) for a substantial period is small, since the liquid is not at the nipple central hole 1302 and therefore the baby is unlikely to maintain the assembly in this position during feeding. Therefore, the additional benefit of including the widened portion 1104 and specific taper 1227 should be weighed against any additional cost associated with manufacturing and possible lack of aesthetic appeal.

The alternate embodiments described above may be implemented singly or in any combination to suit the specific needs of the end user, and although the descriptions above contain many specifics, these should not be construed as limiting the scope of the invention, but merely providing illustrations of some of the presently preferred embodiments. Thus, the scope of the invention should be determined by the appended claims and their legal equivalents, rather than by the examples given.

What is claimed is:

1. An improved bottle assembly consisting of:

(a) a container comprising:

(i) an open top with means to engage a collar (ii) a marking to indicate maximum liquid fill level (b) a vent unit comprising:

(i) a flange with outside dimensions substantially equal to the outside dimensions of the container top, with an internal passage which extends from the side of the flange to its underside, with at least one opening through the flange body to allow passage of liquid, (ii) a vent tube which attaches to and extends downward from the underside of the flange, aligned with the end of the passage in said flange, (iii) a reservoir which is hollow, attaches to the underside of the flange and envelopes the vent tube, (iv) a stem which is hollow, attaches to and is concentric with the underside of the reservoir, and is sized lengthwise so that the bottom of the tube is in close proximity to the bottom of the container, (v) a floating element (vi) a flexible element, (vii) the inside volume of the reservoir being sized so that a volume of liquid equal to the inside volume of the stem contained inside the reservoir could not submerge the vent tube lower end regardless of the spatial orientation of the bottle assembly, (c) a nipple comprising:

(i) a body with a hole through which liquid can be drawn, (ii) a flange with outside dimensions substantially equal to the outside dimensions of the container top outer surface, (d) a collar comprising:

(i) an upper portion sized to accommodate the thickness of the vent unit flange and nipple flange, (ii) a lower portion with means to be secured to the container top.

2. The bottle assembly of claim 1 further incorporating into the container a widened portion sized to allow the bottom opening of the stem to float above the liquid surface when the assembly is rotated into a position less than horizontal.

3. The bottle assembly of claim 1 further incorporating into the reservoir tube, a taper which allows liquid forced into the reservoir tube by external pressure applied to the nipple to flow back out of the reservoir tube when said pressure is relieved, and when the assembly is rotated into a position less than horizontal.

4. The bottle assembly of claim 2 further incorporating into the reservoir tube, a taper which allows liquid forced into the reservoir tube by external pressure applied to the nipple to flow back out of the reservoir tub when said pressure is relieved, and when the assembly is rotated into a position less than horizontal.

5. The bottle assembly of claim 1 wherein the collar and nipple are incorporated into a single element.

6. The bottle assembly of claim 2 wherein the collar and nipple are incorporated into a single element.

7. The bottle assembly of claim 3 wherein the collar and nipple are incorporated into a single element.

8. The bottle assembly of claim 4 wherein the collar and nipple are incorporated into a single element.

* * * * *